US011618960B2

(12) United States Patent
Drago Dragutin et al.

(10) Patent No.: US 11,618,960 B2
(45) Date of Patent: Apr. 4, 2023

(54) CATHODE ASSEMBLY FOR AN ELECTROLYTIC CELL

(71) Applicants: TOKAI COBEX SAVOIE, La Lechere (FR); Metsol AG, Glattbrugg (CH)

(72) Inventors: Juric Drago Dragutin, Glattbrugg (CH); Loig Rivoaland, Aigueblanche (FR)

(73) Assignees: TOKAI COBEX SAVOIE, La Lechere (FR); METSOL AG, Glattbrugg (CH)

( * ) Notice: Subject to any disclaimer, the term of this patent is extended or adjusted under 35 U.S.C. 154(b) by 0 days.

(21) Appl. No.: 17/046,624

(22) PCT Filed: Feb. 14, 2019

(86) PCT No.: PCT/FR2019/050335
§ 371 (c)(1),
(2) Date: Oct. 9, 2020

(87) PCT Pub. No.: WO2019/175486
PCT Pub. Date: Sep. 19, 2019

(65) Prior Publication Data

US 2021/0355591 A1 Nov. 18, 2021

(30) Foreign Application Priority Data

Mar. 12, 2018 (FR) ..... 18/52129

(51) Int. Cl.
*C25C 7/00* (2006.01)
*C25C 3/00* (2006.01)
(Continued)

(52) U.S. Cl.
CPC ..... *C25C 3/08* (2013.01); *C25C 3/16* (2013.01); *C25C 7/025* (2013.01)

(58) Field of Classification Search
CPC .. C25C 3/08; C25C 7/005; C25C 3/06; C25C 7/025; C25C 3/00; C25C 3/125;
(Continued)

(56) References Cited

U.S. PATENT DOCUMENTS 6,113,756 A 9/2000 Juric et al.
7,776,191 B2 * 8/2010 Hiltmann ..... C25C 3/16 204/294

(Continued)

FOREIGN PATENT DOCUMENTS

CN 102230191 A 11/2011
DE 102010041082 A1 3/2012

(Continued)

OTHER PUBLICATIONS

International Search Report for International Application No. PCT/FR2019/050335; Date of Completion: May 8, 2019 dated May 17, 2019; 5 Pages.

(Continued)

*Primary Examiner* — Zulmariam Mendez
(74) *Attorney, Agent, or Firm* — Cantor Colburn LLP

(57) ABSTRACT

A cathode assembly for an electrolytic cell including a cathode block having a second surface and a first surface. The cathode block also including at least one sealing groove opening onto its first surface and a plurality of electrical contact plugs mounted in electrical contact with the first surface of the cathode block. The cathode assembly includes at least one current supply plate in electrical contact with at least one electrical contact plug, and is connected to at least one unit for connection to an electric current source. The cathode assembly includes at least one current supply bar having a coefficient of thermal expansion substantially identical to the coefficient of thermal expansion of the current supply plate and is sealed within the at least one sealing (Continued)

groove while being fastened to at least one current supply plate.

20 Claims, 3 Drawing Sheets

(51) Int. Cl.
*C25C 3/08* (2006.01)
*C25C 3/16* (2006.01)
*C25C 7/02* (2006.01)

(58) Field of Classification Search
CPC .... C25C 3/20; C25C 7/00; C25C 7/06; C25C 3/16; C25C 7/02
See application file for complete search history.

(56) References Cited

U.S. PATENT DOCUMENTS

| | | | | |
|---|---|---|---|---|
| 2016/0208399 | A1 | 7/2016 | Berends et al. | |
| 2019/0271092 | A1* | 9/2019 | Sum | C25C 3/08 |

FOREIGN PATENT DOCUMENTS

| | | | |
|---|---|---|---|
| FR | 2251629 | A1 | 6/1975 |
| FR | 2680800 | A1 | 3/1993 |
| JP | 2017519713 | A | 7/2017 |
| JP | 2017222914 | A | 12/2017 |

OTHER PUBLICATIONS

Written Opinion of the International Searching Authority for International Application No. PCT/FR2019/050335; International Filing Date: Feb. 14, 2019; Priority Date: Mar. 12, 2018; 6 Pages.
English Translation of Written Opinion of the International Searching Authority for International Application No. PCT/FR2019/050335; International Filing Date: Feb. 14, 2019; Priority Date: Mar. 12, 2018; 6 Pages.
Japanese Office Action dated Nov. 2, 2022; JP Application No. 2020-549675, filed Feb. 14, 2019; 12 pages English Translation included.
Japanese Search Report dated Oct. 14, 2022; JP Application No. 2020-549675, filed Feb. 14, 2019; 26 pages; English Translation included.

* cited by examiner

CATHODE ASSEMBLY FOR AN ELECTROLYTIC CELL

CROSS REFERENCE TO RELATED APPLICATIONS

This application is a National Stage of PCT Application No. PCT/FR2019/050335 filed on Feb. 14, 2019, which claims priority to French Patent Application No. 18/52129 filed on Mar. 12, 2018, the contents each of which are incorporated herein by reference thereto.

FIELD OF THE INVENTION

The present invention relates to a cathode assembly for an electrolytic cell.

PRIOR ART

In a known manner, the document U.S. Pat. No. 6,113,756 describes an electrolytic reduction cell for the production of a metal, such as aluminum. In particular, the document U.S. Pat. No. 6,113,756 concerns a cathode construction used in such cells.

Said cathode comprises a carbonaceous block, a plurality of electrical contact plugs mounted in electrical contact with a lower portion of the cathode and at least one collector plate in electrical contact with the electrical contact plugs.

The plurality of electrical contact plugs is positioned or distributed over the lower surface of the cathode such that an equicellential surface is obtained. In particular, the required number of electrical contact plugs may be positioned in the space so as to reduce the undesirable current flows and to produce a minimum electric field resistance between the plugs. With this approach, it is possible to minimize the resistance of the set and control the current distribution in the set.

Nonetheless, these solutions are not fully satisfactory.

Indeed, the use of electrical contact plugs positioned or distributed over the lower surface of the cathode to obtain an equicellential surface results in stiffening of the cathode assembly comprising the cathode and the collector plate.

The collector plate having a coefficient of thermal expansion that is higher than the coefficient of thermal expansion of the cathode, once the cathode assembly is at the use temperature, there is a risk of the collector plate creating cracks in the cathode.

A cracked cathode has a shorter service life than a cathode that is not cracked. Said service life could be reduced to a few days in the case of serious cracks.

The present invention aims at solving all or part of the above-mentioned drawbacks.

DISCLOSURE OF THE INVENTION

To this end, the present invention concerns a cathode assembly for an electrolytic cell comprising:

a. a cathode block having a second surface and a first surface, at least one sealing groove opening onto the first surface, a plurality of electrical contact plugs being mounted in electrical contact with the first surface of the cathode block; and b. at least one current supply plate in electrical contact with at least one electrical contact plug, and which is intended to be connected to at least one unit for connection to an electric current source;

c. at least one current supply bar having a coefficient of thermal expansion substantially identical to the coefficient of thermal expansion of the current supply plate is sealed within the at least one sealing groove and fastened to at least one current supply plate.

Within the meaning of the present invention, «a coefficient of thermal expansion substantially identical» means «an identical coefficient of thermal expansion» or «a coefficient of thermal expansion identical within a 10% margin».

Within the meaning of the present invention, «a coefficient of thermal expansion substantially identical» means «an identical coefficient of thermal expansion» or «a coefficient of thermal expansion identical within a 5% margin».

As example, a measurement of a coefficient of thermal expansion of a current supply bar is carried out by measuring the evolution of the size of said current supply bar as a function of temperature.

According to one advantage, a current supply bar fastened to a current supply plate and sealed to the cathode block allows reducing the electrical resistance of the cathode assembly and therefore allows limiting the number of electrical contact plugs since mechanical holding between the current supply plate and the cathode block is partially ensured by the connection between the current supply bar, the current supply plate and the cathode block.

Sealing of the current supply bar within the sealing groove allows for a degree of freedom of the current supply bar relative to the cathode block.

Moreover, the limitation of the number of contact plugs also allows for a greater mechanical flexibility of the cathode assembly. Thus, the obtained cathode assembly has limited risks of cracking.

According to one embodiment, the current supply bar is fastened by welding to the current supply plate.

According to one advantage, a current supply plate welded to a current supply bar having the same coefficient of thermal expansion allows for an extended service life of the weld.

According to one advantage, a current supply plate welded to a supply bar 30 having the same coefficient of thermal expansion allows limiting the risk of cracking of the cathode block.

According to one embodiment, the electrical contact plugs are mounted in electrical contact with the first surface of the block by insertion of said electrical contact plugs into different bores present over the first surface of said cathode block.

According to one embodiment, the cooperation space between the at least one current supply bar and the cathode block defines a first area. The cooperation space between the electrical contact plugs and the cathode block defines a second area separate from the first area.

According to one advantage, a plurality of electrical contact plugs mounted in electrical contact with the first surface of the cathode block allows improving the distribution of the current lines within said cathode block.

According to one advantage, improving the distribution of the current lines within said cathode block allows improving the performances of the cathode assembly for an electrolytic cell.

According to one advantage, improving the distribution of the current lines within said cathode block allows limiting wear of the cathode block and thus allows extending the service life of the cathode assembly for an electrolytic cell.

According to one advantage, the use of several current supply plates reduces the differential expansion between each current supply plate and the cathode block. The reduction of the differential expansion between each current supply plate and the cathode block allows limiting the risks of cracking of said cathode block.

According to one advantage, limiting the risks of cracking of the cathode block allows extending the service life of the cathode assembly for an electrolytic cell.

According to one advantage, the use of several current supply bars allows facilitating handling of the cathode assembly.

According to one advantage, the use of several current supply bars allows limiting the risk of cracking of the cathode block.

According to one embodiment, sealing of the current supply bar within the sealing groove of the cathode block consists of a sealing with cast iron.

According to one embodiment, sealing with cast iron is done with a phosphorus white cast iron.

According to one embodiment, sealing with cast iron is done with a phosphorus grey cast iron.

According to one advantage, sealing with cast iron allows for a sufficient degree of freedom of the current supply bar relative to the cathode block to limit the risks of cracking of said cathode block.

According to one embodiment, sealing of the current supply bar within the sealing groove of the cathode block consists of a sealing with a sealing paste.

According to one embodiment, sealing with a sealing paste is done with a paste comprising a carbon powder as a binder.

According to one advantage, the sealing paste shrinks during the rise of temperature of the electrolytic cell. A sealing paste shrinking during the rise of temperature of the electrolytic cell allows limiting the risks of cracking of the cathode block induced by the expansion of the current supply bar.

According to one advantage, the sealing paste is a paste free of tar and pitch as well as polycyclic aromatic hydrocarbons.

According to one advantage, the sealing paste is a paste free of any phenolic resin.

According to one embodiment, sealing with the paste is done at cold. According to one advantage, sealing with the paste at cold is energetically efficient.

According to one embodiment, the electrical contact plugs are in the form of a cylinder comprising a deformation groove.

According to one advantage, a deformation groove enables a local deformation of an electrical contact plug and allows said electrical contact plug to have a low elastic strength. An electrical contact plug with a low elastic strength allows limiting the risks of cracking of the cathode block.

According to one embodiment, the deformation groove extends over 5% to 50% of the length of an electrical contact plug.

According to one embodiment, the deformation groove preferably extends over 15% to 35% of the length of the electrical contact plug.

Within the meaning of the present invention, the length is a dimension substantially longer than the other dimensions.

According to one advantage, a deformation groove enables a local deformation of an electrical contact plug and confers on said electrical contact plug the possibility of elastic and plastic deformation of said electrical contact plug. An electrical contact plug adapted to undergo elastic and plastic deformation allows limiting the risks of cracking of the cathode block.

According to one embodiment, the deformation groove has a circular section.

According to one embodiment, the deformation groove has a rectangular section. A rectangular section allows for a guided deformation of the deformation groove.

According to one embodiment, the deformation groove is adapted to delimit at least partially a connecting head and a connecting member on either side of an electrical contact plug.

According to one advantage, the connecting member of an electrical contact plug is adapted to be connected to the cathode block whereas the connecting head of an electrical contact plug is adapted to be connected to a current supply plate.

According to one embodiment, the electrical contact plugs consist of electrical contact plugs with twisted wires bundles.

According to one advantage, electrical contact plugs with twisted wires bundles allow for a low elastic strength and thus limit the risks of cracking of the cathode block.

The cathode assembly for an electrolytic cell according to any one of claims 1 to 4, wherein the electrical contact plugs consist of anisotropic electrical contact plugs.

According to one advantage, an anisotropic electrical contact plug allows for a lower elastic strength of said electrical contact plug and thus limits the risks of cracking of the cathode block.

According to one embodiment, the electrical contact plugs have elastic strengths that are different from each other.

According to one advantage, electrical contact plugs having elastic strengths that are different from each other allows combining a proper fastening of the at least one current supply plate to the cathode block while limiting the risks of cracking of said cathode block.

According to one embodiment, the cathode block is constituted by a mixture of anthracite and graphite.

According to one advantage, a cathode block constituted by a mixture of anthracite and graphite improves the distribution of the current lines within said cathode block.

According to one advantage, a cathode block constituted by a mixture of anthracite and graphite improves the distribution of the current and allows limiting wear of said cathode block and thus allows extending the service life of the cathode assembly for an electrolytic cell.

According to one embodiment, the cathode block 10 is constituted by graphite.

According to one advantage, a cathode block 10 constituted by graphite allows limiting energy consumption during the operation of the electrolytic cell.

According to one embodiment, the number of electrical contact plugs per square meter is comprised between 10 and 80.

According to one embodiment, the number of electrical contact plugs per square meter is preferably comprised between 20 and 65.

According to one embodiment, the number of electrical contact plugs per square meter is ideally comprised between 30 and 50.

According to one advantage, a number of electrical contact plugs per square meter comprised between 10 and 80 allows for a proper connection between the at least one current supply plate and the cathode block.

According to another advantage, a number of electrical contact plugs per square meter comprised between 10 and 80 allows limiting the risks of cracking of the cathode block.

According to one advantage, a number of electrical contact plugs per square meter comprised between 10 and 80 improves the distribution of the current lines within said cathode block.

The invention also concerns an electrolytic cell for the production of a metal, comprising:

d. an external envelope made of steel;

e. a layer of an insulating material adjacent to the steel-made external shell;

f. a carbonaceous layer covering the insulating material and protecting the insulating material of an electrolytic bath intended to be contained in the cell; and g. a cathode assembly for an electrolytic cell according to any one of claims 1 to 9.

The different aspects defined hereinabove that are not incompatible may be combined together.

BRIEF DESCRIPTION OF THE FIGURES

The invention will be better understood using the detailed description that is disclosed hereinbelow with regards to the appended drawings in which.

DESCRIPTION WITH REFERENCE TO THE FIGURES

Figure 1:
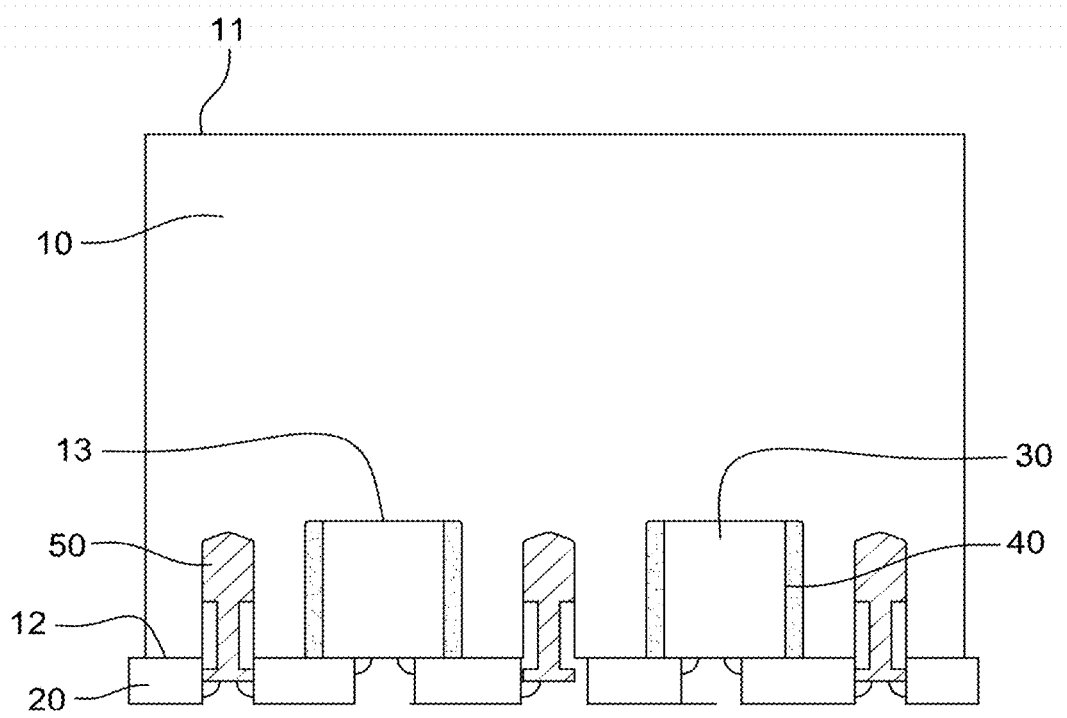
FIG. 1 represents a sectional view of a cathode assembly in accordance with the present invention.
Figure 2:
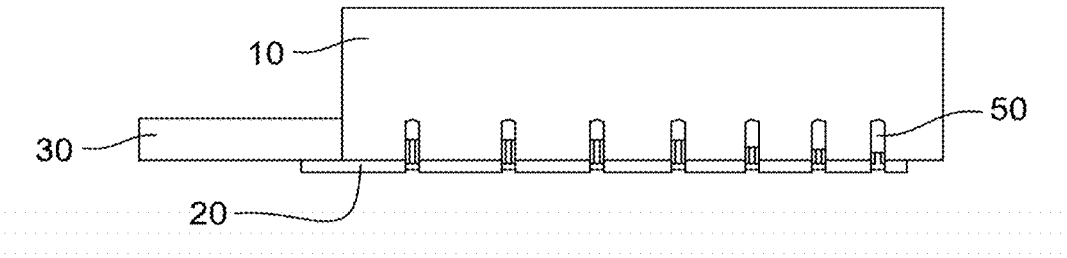
FIG. 2 represents a sectional view of a cathode assembly in accordance with the present invention.
Figure 3:
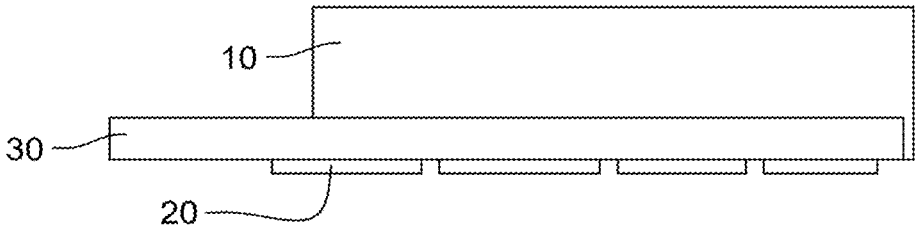
FIG. 3 represents a sectional view of a cathode assembly in accordance with the present invention.

FIGS. 1 to 3 represent a cathode assembly for an electrolytic cell comprising a cathode block 10, a current supply plate 20 and two current supply bars 30.

Figure 4:
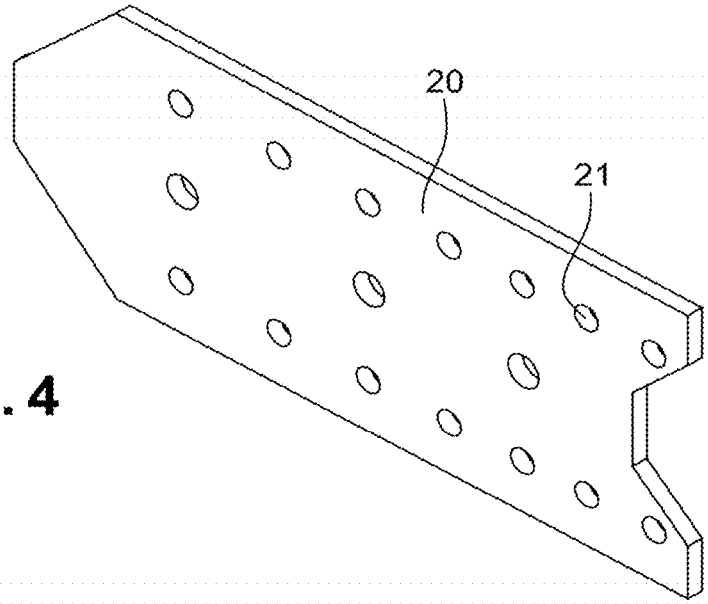
FIG. 4 represents a current supply plate in accordance with the present invention.

FIG. 4 illustrates a current supply plate 20 comprising several insertion orifices 21.

Figure 5:
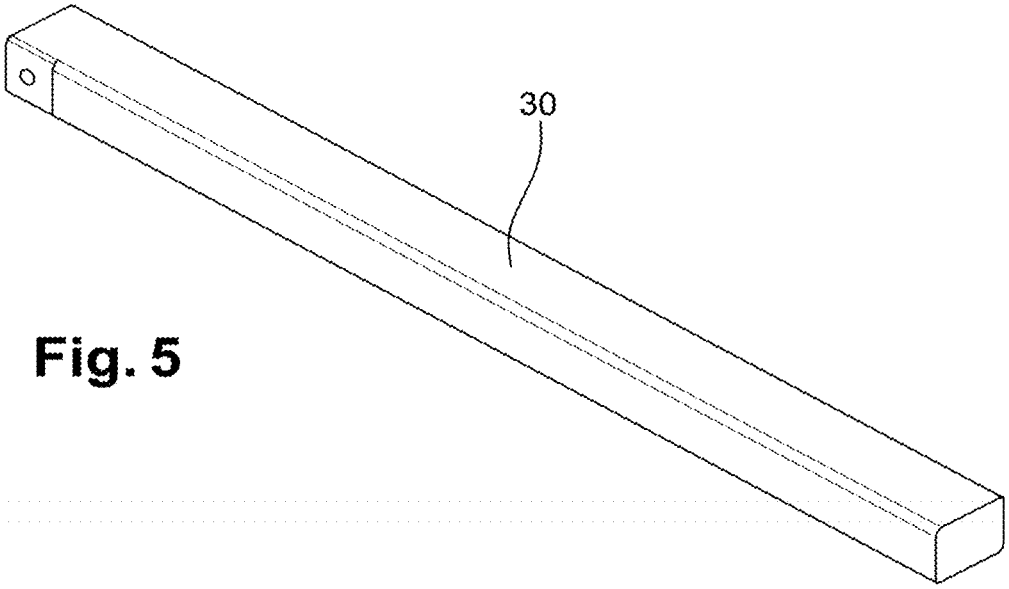
FIG. 5 represents a current supply bar in accordance with the present invention.

FIG. 5 illustrates a current supply bar 30.

Figure 7:
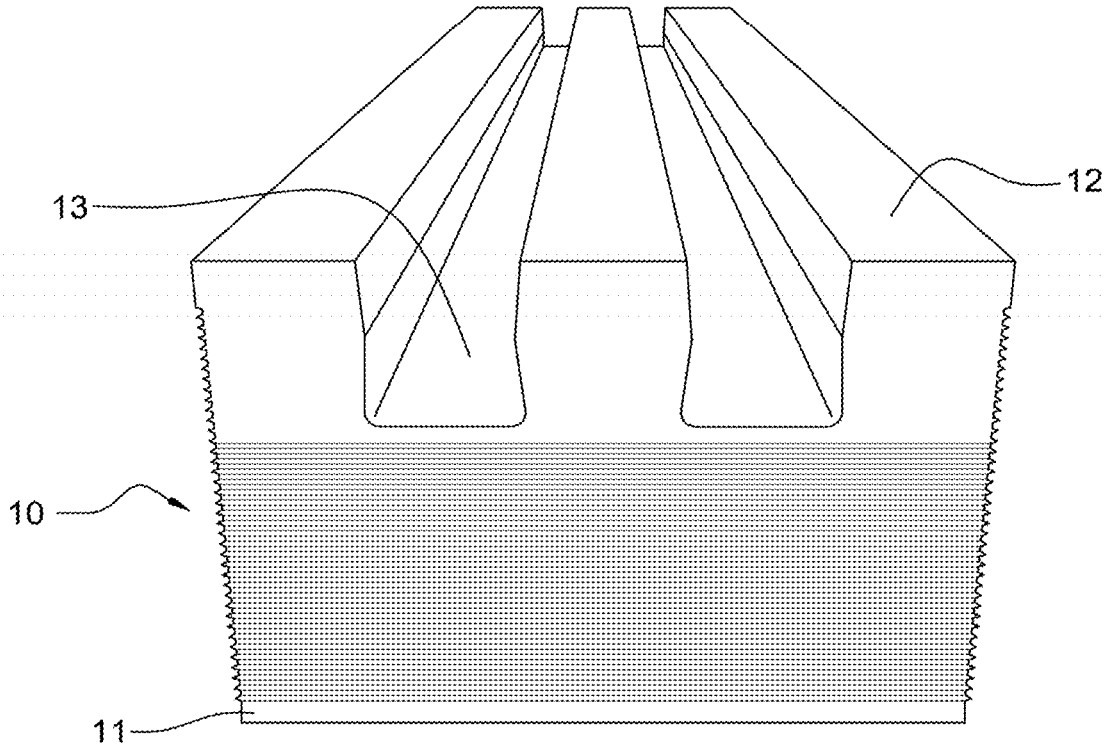
FIG. 7 represents a cathode block in accordance with the present invention.

FIG. 7 represents a cathode block 10 having a second surface 11 and a first surface 12, two sealing grooves 13 opening onto the first surface 12 and a plurality of electrical contact plugs 50.

According to one embodiment, the cathode block 10 is constituted by graphite.

According to one advantage, a cathode block 10 constituted by graphite allows limiting energy consumption during the operation of the electrolytic cell.

According to one embodiment, the cathode block 10 is constituted by a mixture of anthracite and graphite.

According to one advantage, a cathode block 10 constituted by a mixture of anthracite and graphite improves the distribution of the current and allows limiting wear of said cathode block 10 and thus allows extending the service life of the cathode assembly for an electrolytic cell.

Figure 6:
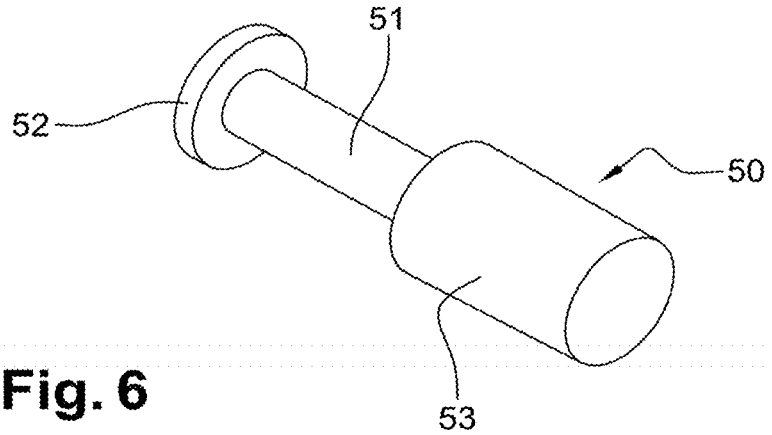
FIG. 6 represents an electrical contact plug in accordance with the present invention.

FIG. 6 illustrates an electrical contact plug 50 in the form of a cylinder comprising a deformation groove 51.

According to one advantage, a deformation groove 51 enables a local deformation of an electrical contact plug 50 and enables said electrical contact plug 50 to have a low elastic strength.

According to one embodiment, the deformation groove 51 extends over 5% to 50% of the length of the electrical contact plug 50.

According to one embodiment, the deformation groove 51 preferably extends over 15% to 35% of the length of the electrical contact plug 50.

Within the meaning of the present invention, the length is a dimension substantially longer than the other dimensions.

According to one advantage, a deformation groove 51 extending over 5% to 50% of the length of an electrical contact plug 50 allows for an elastic and plastic deformation of said electrical contact plug 50.

According to one embodiment, the deformation groove 51 has a circular section.

According to one embodiment, the deformation groove 51 has a rectangular section. A rectangular section allows for a guided deformation of the deformation groove 51.

According to one embodiment, the deformation groove 51 is adapted to delimit at least partially a connecting head 52 and a connecting member 53 on either side of the electrical contact plug 50.

As illustrated in FIG. 1, the electrical contact plugs 50 are mounted in electrical contact with the first surface 12 of the cathode block 10.

According to one embodiment, the electrical contact plugs 50 are mounted in electrical contact with the first surface of the block by insertion of said electrical contact plugs 50 into different bores present over the first surface of said cathode block 50.

According to one embodiment, the current supply bar 30 is sealed within the at least one sealing groove 13.

Sealing of the current supply bar 30 within the sealing groove 13 allows for a degree of freedom of the current supply bar 30 relative to the cathode block 10.

According to one embodiment, sealing of the current supply bar 30 within the sealing groove 13 of the cathode block 10 consists of sealing with cast iron.

According to one embodiment, sealing with cast iron is done with a phosphorus white cast iron.

According to one embodiment, sealing with cast iron is done with a phosphorus grey cast iron.

According to one advantage, sealing with cast iron allows for a sufficient degree of freedom of the current supply bar 30 relative to the cathode block 10 to limit the risks of cracking of said cathode block 10.

According to one advantage, limiting the risks of cracking of the cathode block 10 allows extending the service life of the cathode assembly for an electrolytic cell.

According to one embodiment, sealing of the current supply bar 30 within the sealing groove 13 of the cathode block 10 consists of sealing with a sealing paste 40.

According to one embodiment, sealing with a sealing paste 40 is done with a paste comprising a carbon powder as a binder.

According to one advantage, the sealing paste 40 shrinks during the rise of temperature of the electrolytic cell. A sealing paste shrinking during the rise of temperature of the electrolytic cell allows limiting the risks of cracking of the cathode block 10 induced by the expansion of the current supply bar 30.

As example, a measurement of a coefficient of thermal expansion of a current supply bar 30 is carried out by measuring the evolution of the size of said current supply bar 30 as a function of temperature.

According to one advantage, the sealing paste 40 is a paste free of tar and pitch as well as polycyclic aromatic hydrocarbons.

According to one advantage, the sealing paste 40 is a paste free of any phenolic resin.

According to one embodiment, sealing with the paste is done at cold. According to one advantage, sealing with the paste at cold is energetically efficient.

According to one embodiment, the cooperation space between the at least one current supply bar 30 and the cathode block 10 defines a first area. The cooperation space between the electrical contact plugs 50 and the cathode block 10 defines a second area separate from the first area.

According to one embodiment, the current supply bar 30 is fastened to at least one current supply plate 20.

According to one embodiment, the current supply bar 30 is fastened by welding to the current supply plate 20.

According to one embodiment, the current supply bar 30 has a coefficient of thermal expansion substantially identical to the coefficient of thermal expansion of the current supply plate 20.

Within the meaning of the present invention, «a coefficient of thermal expansion substantially identical» means «an identical coefficient of thermal expansion» or «a coefficient of thermal expansion identical within a 10% margin».

Within the meaning of the present invention, «a coefficient of thermal expansion substantially identical» means «an identical coefficient of thermal expansion» or «a coefficient of thermal expansion identical within a 5% margin».

According to one advantage, a current supply plate 20 welded to a supply bar 30 having the same coefficient of thermal expansion allows for an extended service life of the weld.

According to one advantage, a current supply plate 20 welded to a supply bar 30 having the same coefficient of thermal expansion allows limiting the risk of cracking of the cathode block 10. According to one embodiment, the current supply plate 20 is in electrical contact with at least one electrical contact plug 50 and comprises at least one unit for connection to an electric current source.

According to one embodiment, the electrical contact plugs 50 are inserted into insertion orifices 21 of the current supply plate 20.

According to one advantage, a current supply bar 30 fastened to a current supply plate 20 and sealed to the cathode block 10 allows reducing the electrical resistance of the cathode assembly and therefore allows limiting the number of electrical contact plugs 50 since mechanical holding between the current supply plate 30 and the cathode block 20 is partially ensured by the connection between the current supply bar 30, the current supply plate 20 and the cathode block 10.

Moreover, the limitation of the number of contact plugs 50 also allows for a greater mechanical flexibility of the cathode assembly. Thus, the obtained cathode assembly has limited risks of cracking of the cathode block.

According to one advantage, a plurality of electrical contact plugs 50 mounted in electrical contact with the first surface 12 of the cathode block 10 allows obtaining a better distribution of the current lines within the cathode block 10.

According to one advantage, a cathode block 10 constituted by a mixture of anthracite and graphite improves the distribution of the current lines within said cathode block 10.

According to one advantage, a better distribution of the current lines within the cathode block 10 allows improving the performances of the cathode assembly for an electrolytic cell.

According to one advantage, a better distribution of the current lines within the cathode block 10 allows limiting wear of the cathode block 10 and thus allows extending the service life of the cathode assembly for an electrolytic cell.

According to one embodiment, the electrical contact plugs 50 are in the form of a cylinder comprising a deformation groove 51.

According to one advantage, a deformation groove 51 enables a local deformation of an electrical contact plug 50 and confers on said electrical contact plug 50 the possibility of elastic and plastic deformation of said electrical contact plug 50. An electrical contact plug 50 adapted to undergo elastic and plastic deformation allows limiting the risks of cracking of the cathode block 10.

According to one advantage, the connecting member 53 of an electrical contact plug 50 is adapted to be connected to the cathode block 10 whereas the connecting head 52 of an electrical contact plug 50 is adapted to be connected to a current supply plate 20.

According to one embodiment, the electrical contact plugs 50 consist of electrical contact plugs 50 with twisted wires bundles.

According to one advantage, electrical contact plugs 50 with twisted wires bundles allow for a low elastic strength and thus limit the risks of cracking of the cathode block 10.

According to one embodiment, the electrical contact plugs 50 consist of anisotropic electrical contact plugs 50.

According to one advantage, an anisotropic electrical contact plug 50 allows for a lower elastic strength of said electrical contact plug 50 and thus limits the risks of cracking of the cathode block 10.

According to one embodiment, the electrical contact plugs 50 have elastic strengths that are different from each other.

According to one advantage, electrical contact plugs 50 having elastic strengths that are different from each other allows combining a proper fastening of the at least one current supply plate 20 to the cathode block 10 while limiting the risks of cracking of said cathode block 10.

According to one embodiment, the number of electrical contact plugs 50 per square meter is comprised between 10 and 80.

According to one embodiment, the number of electrical contact plugs 50 per square meter is preferably comprised between 20 and 65.

According to one embodiment, the number of electrical contact plugs 50 per square meter is ideally comprised between 30 and 50.

According to one advantage, a number of electrical contact plugs 50 per square meter comprised between 10 and 80 allows for a proper connection between the at least one current supply plate 20 and the cathode block 10.

According to another advantage, a number of electrical contact plugs 50 per square meter comprised between 10 and 80 allows limiting the risks of cracking of the cathode block 10.

According to one advantage, a number of electrical contact plugs 50 per square meter comprised between 10 and 80 improves the distribution of the current lines within said cathode block 10.

According to one embodiment, the cathode assembly comprises two current supply bars 30 for each sealing groove 13.

According to one advantage, the use of two current supply bars 30 allows facilitating handling of the cathode assembly.

According to one advantage, the use of two current supply bars 30 allows limiting the risk of cracking of the cathode block 10.

According to an embodiment which is not represented, several current supply plates 20 are fastened to the current supply bar 30.

According to one advantage, the use of several current supply plates 20 reduces the differential expansion between each current supply plate 20 and the cathode block 10. The reduction of the differential expansion between each current supply plate 20 and the cathode block 10 allows limiting the risks of cracking of said cathode block 10.

The invention also concerns an electrolytic cell for the production of a metal, comprising:

an external envelope made of steel;

a layer of an insulating material adjacent to the steel-made external shell;

a carbonaceous layer covering the insulating material and protecting the insulating material of an electrolytic bath intended to be contained in the cell; and a cathode assembly for an electrolytic cell.

Of course, the invention is not limited to the embodiments represented and described hereinbefore, but covers, on the contrary, all variants thereof.

The invention claimed is:

1. A cathode assembly for an electrolytic cell comprising:

a. a cathode block having a first surface, at least one sealing groove opening onto the first surface, and a plurality of electrical contact plugs being mounted in electrical contact with the first surface of the cathode block;

b. at least one current supply plate in electrical contact with at least one of the plurality of electrical contact plugs, and which is intended to be connected to at least one unit for connection to an electric current source; and c. at least one current supply bar sealed within the at least one sealing groove and fastened to at least one current supply plate, the at least one current supply plate and the at least one current supply bar having a same coefficient of thermal expansion to prevent formation of cracks in the cathode assembly when the cathode assembly is heated at a use temperature.

2. The cathode assembly for an electrolytic cell according to claim 1, wherein sealing of the at least one current supply bar within the at least one sealing groove of the cathode block consists of sealing with a cast iron.

3. The cathode assembly for an electrolytic cell according to claim 1, wherein sealing of the at least one current supply bar within the at least one sealing groove of the cathode block consists of sealing with a sealing paste.

4. The cathode assembly for an electrolytic cell according to claim 1, wherein the plurality of electrical contact plugs are in the form of a cylinder comprising a deformation groove.

5. The cathode assembly for an electrolytic cell according to claim 1, wherein the plurality of electrical contact plugs include twisted wires bundles.

6. The cathode assembly for an electrolytic cell according to claim 1, wherein the plurality of electrical contact plugs are anisotropic electrical contact plugs.

7. The cathode assembly for an electrolytic cell according to claim 1, wherein the plurality of electrical contact plugs have elastic strengths that are different from each other.

8. The cathode assembly for an electrolytic cell according to claim 1, wherein the cathode block is constituted by a mixture of anthracite and graphite.

9. The cathode assembly for an electrolytic cell according to claim 1, wherein a number of the plurality of electrical contact plugs per square meter is comprised between 10 and 80.

10. An electrolytic cell for the production of a metal, comprising:

a. an external envelope made of steel;

b. a layer of an insulating material adjacent to the external envelope;

c. a carbonaceous layer covering the layer of insulating material and protecting the layer of insulating material from an electrolytic bath intended to be contained in the electrolytic cell; and d. a cathode assembly for an electrolytic cell comprising:

a cathode block having a first surface, at least one sealing groove opening onto the first surface, and a plurality of electrical contact plugs being mounted in electrical contact with the first surface of the cathode block;

at least one current supply plate in electrical contact with at least one of the plurality of electrical contact plugs, and which is intended to be connected to at least one unit for connection to an electric current source; and at least one current supply bar sealed within the at least one sealing groove and fastened to the at least one current supply plate, the at least one current supply bar and the at least one current supply plate having a same coefficient of thermal expansion to prevent formation of cracks in the cathode assembly when the cathode assembly is heated at a use temperature.

11. The cathode assembly for an electrolytic cell according to claim 2, wherein the plurality of electrical contact plugs are in the form of a cylinder comprising a deformation groove.

12. The cathode assembly for an electrolytic cell according to claim 11, wherein the plurality of electrical contact plugs include twisted wires bundles.

13. The cathode assembly for an electrolytic cell according to claim 12, wherein the plurality of electrical contact plugs are anisotropic electrical contact plugs.

14. The cathode assembly for an electrolytic cell according to claim 13, wherein the plurality of electrical contact plugs have elastic strengths that are different from each other.

15. The cathode assembly for an electrolytic cell according to claim 14, wherein the cathode block is constituted by a mixture of anthracite and graphite.

16. The cathode assembly for an electrolytic cell according to claim 15, wherein a number of the plurality of electrical contact plugs per square meter is comprised between 10 and 80.

17. The cathode assembly for an electrolytic cell according to claim 3, wherein the plurality of electrical contact plugs are in the form of a cylinder comprising a deformation groove.

18. The cathode assembly for an electrolytic cell according to claim 17, wherein the plurality of electrical contact plugs include twisted wires bundles.

19. The cathode assembly for an electrolytic cell according to claim 18, wherein the plurality of electrical contact plugs are anisotropic electrical contact plugs.

20. The cathode assembly for an electrolytic cell according to claim 19, wherein the plurality of electrical contact plugs have elastic strengths that are different from each other.

* * * * *